United States Patent [19]

Giffard

[11] Patent Number: 4,476,980

[45] Date of Patent: Oct. 16, 1984

[54] SPIRAL SEPARATOR

[75] Inventor: Philip J. Giffard, Nerang, Australia

[73] Assignee: Mineral Deposits Limited, Australia

[21] Appl. No.: 444,895

[22] PCT Filed: Mar. 17, 1982

[86] PCT No.: PCT/AU82/00032

§ 371 Date: Nov. 17, 1982

§ 102(e) Date: Nov. 17, 1982

[87] PCT Pub. No.: WO82/03187

PCT Pub. Date: Sep. 30, 1982

[30] Foreign Application Priority Data

Mar. 18, 1981 [AU] Australia ..... PE8046

[51] Int. Cl.[3] ..... B03B 5/52

[52] U.S. Cl. ..... 209/459; 209/697; 209/493

[58] Field of Search ..... 209/458, 459, 656, 657, 209/696, 697, 157, 208, 474, 477, 493

[56] References Cited

U.S. PATENT DOCUMENTS

| | | | |
|---|---|---|---|
| 629,590 | 7/1899 | Pardee | 209/697 |
| 923,988 | 6/1909 | Mullen . | |
| 1,040,374 | 10/1912 | Middleton et al. . | |
| 1,462,618 | 6/1923 | Pardee | 209/697 |
| 1,698,101 | 1/1929 | Martling . | |
| 1,880,185 | 9/1932 | Kerns et al. . | |
| 2,425,110 | 8/1947 | McCurdy . | |
| 2,431,559 | 11/1947 | Humphreys . | |
| 2,431,560 | 11/1947 | Humphreys . | |
| 2,615,572 | 10/1952 | Hodge . | |
| 2,700,469 | 1/1955 | Humphreys . | |
| 3,099,621 | 7/1963 | Close . | |
| 3,319,788 | 5/1967 | Reichert . | |
| 3,371,784 | 3/1968 | Conway . | |
| 3,568,832 | 3/1971 | Persson . | |
| 3,910,835 | 10/1975 | Stafford . | |
| 4,059,506 | 11/1977 | Bryson . | |
| 4,142,965 | 3/1979 | Dolan . | |
| 4,146,137 | 3/1979 | Beckhan . | |
| 4,189,378 | 2/1980 | Wright et al. . | |
| 4,277,330 | 7/1981 | Wright et al. . | |
| 4,324,334 | 4/1982 | Wright et al. | 209/459 |
| 4,384,650 | 5/1983 | Wright . | |

FOREIGN PATENT DOCUMENTS

| | | |
|---|---|---|
| 5520580 | 1/1980 | Australia . |
| 6943681 | 4/1981 | Australia . |
| 7429781 | 8/1981 | Australia . |
| 1132511 | 7/1962 | Fed. Rep. of Germany . |

*Primary Examiner*—David A. Scherbel
*Assistant Examiner*—Glenn B. Foster
*Attorney, Agent, or Firm*—Stevens, Davis, Miller & Mosher

[57] ABSTRACT

The invention provides a spiral separator of the type for use in separating a pulp of water and minerals into mineral fractions of differing densities and having a helical trough (30) supported with its axis upright. The shape of the trough working surface profile (30) varies (FIGS. 2A–2D) from place to place along the trough. The profile has a point of maximum displacement (32A, 32B, 32C, 32D) at which profile (30) is at a maximum spacing below a notional straight line (40) joining the inner end (31) and outer end (22) of the trough working surface profile (30). The distance of the point of maximum displacement (32A, 32B, 32C, 32D) from one end (31 or 22) of the profile varies along the trough. A method for manufacture of troughs according to the invention is also described and claimed.

28 Claims, 6 Drawing Figures

SPIRAL SEPARATOR

TECHNICAL FIELD OF THE INVENTION

This invention relates to an improved spiral separator and to a method of spiral separation which are of particular use in the separation of minerals.

BACKGROUND ART

Spiral separators are extensively used for the wet gravity separation of solids according to their specific gravity, for example for separating various kinds of mineral sands from silica sand.

Separators of the kind under discussion commonly comprise a vertical column about which there are supported one or more helical troughs.

Reference herein to "cross section" in relation to a trough means, unless the contrary is expressed, a cross section taken in a vertical plane extending radially from the helix axis.

Each trough has a floor situated between an outer trough wall and an inner trough wall. As herein used, the expression "Working surface" means that portion of the trough floor which in use supports pulp or solids. The expression "working surface profile" means any profile of the working surface viewed in a cross section taken in a vertical plane extending radially from the helix axis. The trough working surface profile generally inclines upwardly and outwardly, from the radially inner wall or column towards the radially outer wall. In some separators the column may be, or may be a part of, the inner trough wall. It will be understood that the trough floor at, or adjacent to, the radially innermost end of the working surface profile may curve inwardly upwards to blend with the inner wall or column. Likewise at or adjacent to the radially outermost end of the working surface profile, the floor may curve upwardly to blend with the outer wall. The radially inner and outer walls serve to retain materials but generally play no role in the separation process.

In operation of such separators, a "pulp" of slurry of the materials to be separated and water is introduced to the upper end of a trough at a predetermined rate and as the pulp descends the helix, centrifugal forces act on less dense particles in a radially outwards direction while denser particles segregate to the bottom of the flow and after slowing through close approach to the working surface gravitate towards the column. The streams are separated at intervals by adjustable splitters, the mineral fractions to be recovered being carried away through take off openings associated with the splitters.

In the most usual form of spiral separator a number of adjustable splitters are employed along the length of each helix with the section of trough between each splitter and the next being essentially identical with the section of trough between any other splitter and the next. Some of the heavier mineral is separated in each trough section and removed by the subsequent splitter. To assist the removal of low specific gravity particles from the underlying high specific gravity particles it is often necessary to supply from a separate system a small amount of water flowing radially outwards. This is normally referred to as wash water. Both the splitters and wash water systems may require periodic adjustment. Commonly two or three helices are supported by the column each with a number of splitters and each helix is mounted so that the starts are equiangularly spaced about the column and as close as practicable to coplanar to facilitate the simultaneous feed of pulp to all three.

Separators of the kind described above are inherently expensive to manufacture and require a high degree of supervision in operation to achieve acceptable results.

DISCLOSURE OF INVENTION

Preferred embodiments of the present invention permit the segregation and separation of the heavier particles of a pulp and their separation from lighter particles to proceed with a reduced need for periodical removal of heavy particles via a splitter. The number of splitters required per trough is thus greatly reduced. In addition, preferred embodiments permit thin films of the water originally present in the pulp to flow with a radially outwards component in the areas in which light particles overlie heavy particles to achieve the function of the wash water separately supplied in prior art spiral separators.

Preferred embodiments of the present invention enable the production of a concentrate of mineral sands almost free of low specific gravity particles, and where multiple types of high specific gravity particles are present in the feed, enable preferential extraction of various types at various levels. Moreover this may be achieved with greater efficiency and less frequent adjustment than has been necessary with prior art separators.

Accordingly to a first aspect the present invention has a spiral separator of the type comprising a helical trough supported with its helical axis upright and adapted to separate a pulp of water and minerals flowing theredown into mineral fractions of differing mineral density, said separator being characterised in that the shape of the working surface profile varies from place to place along the trough and in that the distance of the point of maximum displacement (as herein defined) from one end of the profile also varies from place to place along the trough.

As herein used the expression "Point of Maximum Displacement" means, in relation to a trough working surface profile, the point or zone at which the profile is at a maximum spacing below a notional straight line joining the radially inner end and the radially outer end of said working surface profile.

In preferred embodiments of the invention the working surface profile alters progressively and uniformly as the helix is descended.

For preference, prior to a splitter, the point of maximum displacement moves progressively radially outwards across a working surface a constant inside and outside diameter but in other embodiments the same relative effect is achieved by variation of the profile inside diameter or the outside diameter and the point of maximum displacement as the helix is descended.

Also, for preference, the profile comprises an inner zone between the point of maximum displacement and the radially inner end of the profile which is rectilinear and an outer zone between the point of maximum displacement and the radially outer end of the profile which is rectilinear. The rectilinear inner and rectilinear outer zones lie at an angle having the point of maximum displacement as an apex. In other embodiments the working surface profile is dished so as to extend curvilinearly between the inner end and outer end thereof. In that event the point of maximum displacement is also preferably the point of maximum curvature of the profile.

BRIEF DESCRIPTION OF DRAWINGS

By way of example only, various embodiments of the invention will now be described with reference to the accompanying drawings wherein.

DESCRIPTION OF EMBODIMENTS

Figure 1:
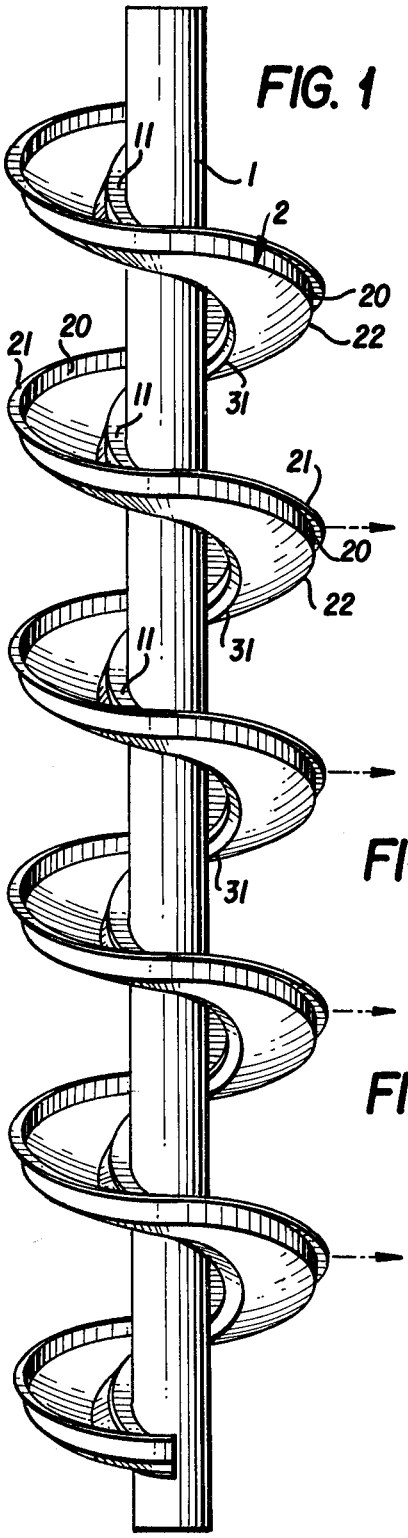
FIG. 1 is an elevation showing a helical trough, a part of a first embodiment, supported by a column.

With reference to FIG. 1 there is shown an upright column 1 supporting a hellical trough 2. Conventional means (not shown in FIG. 1) are provided for admitting a slurry to the trough at a predetermined rate to or adjacent the top and for splitting the descending slurry stream into fractions and recovering certain desired fractions.

The trough cross-section in the helix radial direction, is shown in FIGS. 2A–2D.

Figure 2A:
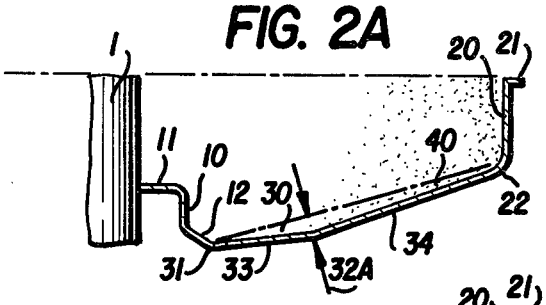
FIGS. 2A to 2D show cross-sections of the helical trough taken in the helix radial direction respectively at descending altitudes of the helix.
Figure 2B:
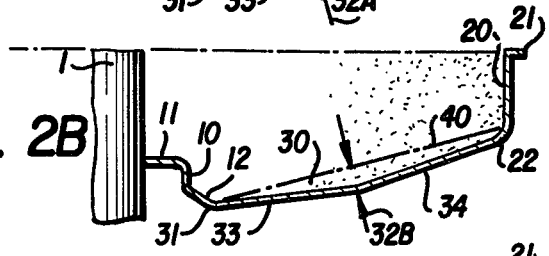
Figure 2C:
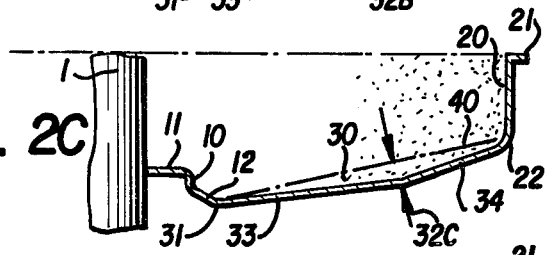
Figure 2D:
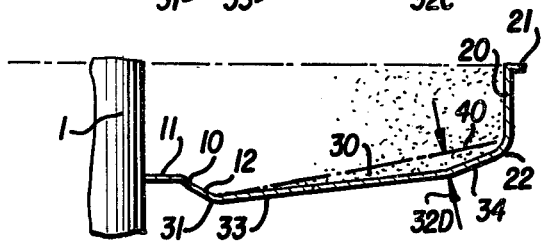

FIG. 2A shows a trough cross-section near the top of the helix and FIGS. 2B, 2C and 2D show the cross-section at respectively lower altitudes.

The trough in cross-section comprises an upright inner wall 10, a support web 11 whereby the lip of inner wall 10 is connected with column 1, an upright outer wall 20 terminating in a lip 21 and a trough floor 30 extending between the inner wall and the outer wall.

Trough floor 30 has a working surface which extends outwardly and upwardly with respect to the helix radial direction from a lowermost point 31. In the example illustrated the working surface profile inner end is at lowermost point 31 of floor 30 and the outer end is at the heel 22 of outer wall 20. In other embodiments the working surface profile inner end need not be the lowermost point thereof and the outer end of the working surface need not be at the heel, if any, of the outer wall but it will be apparent to those skilled in the art where the inner and outer ends of the working surface lie.

The point of maximum displacement 32 is spaced apart from and below a notional line 40 (shown as a broken line in FIGS. 2A to 2D) which extends between the radially inner end 31 and the radially outer end 22 of the working surface profile. The point of maximum displacement is the point on the working surface profile which is at a maximum displacement below line 40.

In the present example the trough working surface comprises an inner zone 33 which lies substantially in a straight line inclined to the horizontal and sloping upwardly from the lowermost point 31 to a point of maximum displacement 32 situated radially outwardly of lowermost point 31. The trough working surface profile further comprises an outer zone 34 which also lies substantially in a straight line but which is inclined at a greater angle to the helix radial direction and thus slopes more steeply upwardly and outwardly from the point of maximum displacement 32 towards outer wall 20.

In the example illustrated the point of maximum displacement 32 is also the apex of an obtuse angle formed at the intersection of the line on which the inner zone 33 and the line on which outer zone 34 of the trough floor lie.

Inner wall 10 curves at 12 to blend smoothly with trough floor 30 at lowermost point 31. As herein defined curve 12 is not a part of the trough working surface and is regarded as a part of inner wall 10 by virtue that in use that part of the trough does not support pulp or minerals.

Trough floor 30 is connected with outer wall 20 by a curve 22 which is herein considered to form a part of outer wall 30 rather than of the trough working surface.

Figure 3:
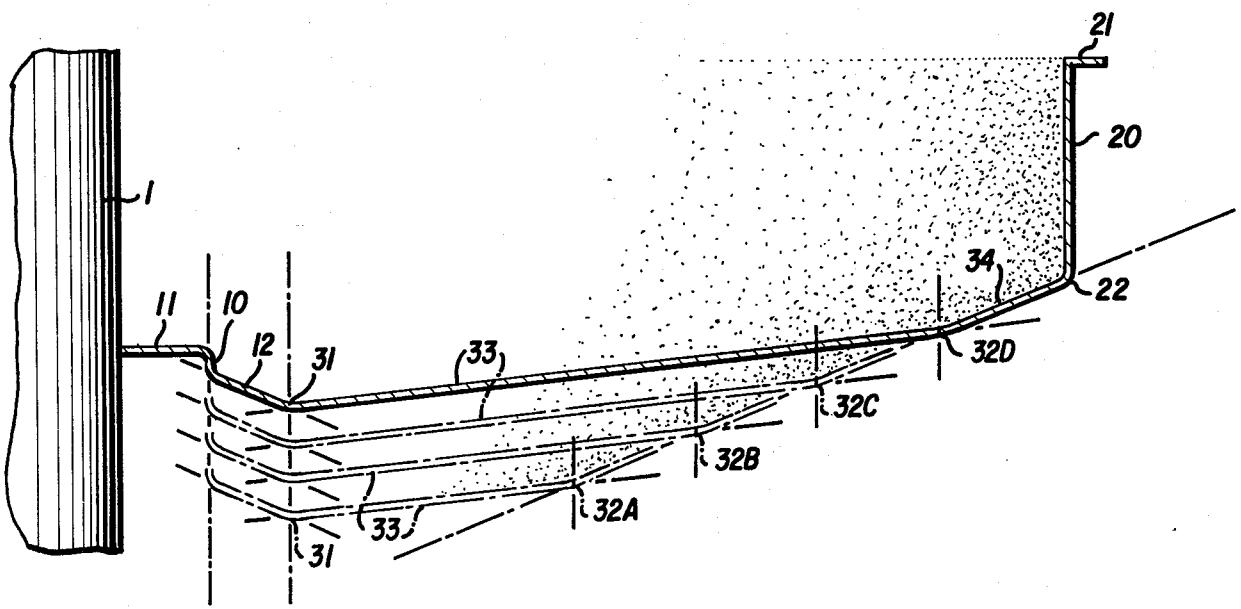
FIG. 3 show the cross-setions of FIGS. 2A–2D superimposed one on the other.

As is most apparent from FIG. 3, the shape of the working surface profile varies from place to place along the trough and the point of maximum displacement 32 is situated at distance from the inner end 31 which becomes greater as the helix is descended. It should be noted that the profiles shown in FIGS. 2A to 2D are at progressively lower altitudes of the helix and in FIG. 3 the cross-section marked A is in fact at a higher altitude of the helix than the cross-section marked D.

In the embodiment being described the inner end of each trough working surface profile is at a substantially uniform radial distance from the helix axis, the point of maximum displacement moves radially outwardly, and the inner zone extends over a progressively greater distance as the helix is descended.

Also, in the embodiment illustrated, outer wall 20 is at a substantially uniform distance from the spiral axis and the outer zone is progressively shortened with respect to the radial direction as the inner zone lengthens with descent of the helix.

Furthermore in the embodiment illustrated the slope of the inner zone is maintained at a constant angle to the helix radial direction as the helix is descended and the slope of the outer zone is maintained at a second constant angle to the helix radial direction.

In the embodiment illustrated the upper lip of inner wall 10 and of outer wall 20 are maintained at a constant pitch and the depth from the inner wall lip to the lowermost point of the trough becomes more shallow as the helix is descended.

It is believed that the separation functions as follows:

The slope of the floor radially downwards towards the helix axis tends to gravitate descending particles towards the helix axis.

Centrifugal forces opposing gravitation of particles tend to stream less dense particles radially outwards.

Particles in contact with the trough working surface tend to move slowly and the effect of centrifugal force acting on those particles is reduced.

High specific gravity particles tend to segregate onto the working surface and therefore to slow and gravitate radially inwards if the radial slope is suitable.

Low specific gravity particles tend to float on the higher specific gravity particles but under suitable conditions of velocity and local water content displace radially outwards.

By virtue that the radially outer zone of the trough working surface slopes more steeply, high specific gravity (and slower) particles are assisted to migrate inwards while the flatter sloped inner zone of the bottom assists low specific gravity (fast) particles to migrate outwards.

Furthermore, in preferred embodiments of the invention wherein the inner zone of lesser slope extends radially outwards over a greater distance as the helix is descended then, as the separation proceeds the high specific gravity particles become stabilized in a low speed layer adjacent the surface of the inner portion.

These particles may therefore be spread to a greater radius without loss due to centrifical force while increasing the possibility of rejecting low specific gravity particles to the radially outer areas due to the greater centrifugal forces acting on these higher speed particles.

The change in the profile of the working portion of the bottom of the trough also controls the radial distribution of the water in the slurry in that the mass of water is permitted to move radially outwards as the centre of curvature of the bottom of the trough moves radially outwards. This in turn causes thinning of the water layer towards the inner edge until a point is reached at which waves inevitably form in the film. The wave fronts tend to move tangentially to the helical flow and therefore have a component of movement radially outwards. If the profile is correctly designed these waves can be generated in the area in which light particles overlie heavy particles and the wave action in the thin film effectively performs the same function as the wash water separately supplied in earlier forms of spiral separators.

In practice when separating mineral sands, splitters are arranged to produce four products:

(a) concentrate consisting predominantly of higher specific gravity particles.

(b) middlings which include particles which may fall in specific gravity between those in the concentrate and those in the tailings, or a mixture of high and low specific gravity particles which the device has not succeeded in separating into concentrate or tailings.

(c) tailings-solids fraction which includes the bulk of the granular waste particles and some of the water.

(d) tailings-water fraction which includes (i) water not required for handling granular tailings (ii) some granular tailings (iii) small, high specific gravity particles, which can become trapped in the high velocity water stream but may be recovered by separate treatment of the water stream.

The more nearly horizontal slope of the inner zone at all levels enables the provision of efficient splitting and draw-off means at upper levels of the helix than is obtainable with helixes having a steeply sloped or radiused bottom at upper levels.

In another embodiment (not illustrated) the trough cross-section does not alter continuously in cross-section from that shown in FIG. 2A to that shown successively in FIGS. 2B, 2C and 2D. Instead the spiral is constructed from helix portions each of a constant cross-section, respectively as shown in FIGS. 2A to 2D and transition are provided between each helix portion. For preference the transition occurs over less than one turn of the helix, for example half a turn.

It is not essential that the working portion of the trough bottom in cross-section be composed of two straight lines. The bottom may be curved between the lowermost point and the point of maximum displacement, and/or between the point of maximum displacement and the outer wall.

It is not essential but highly desirable that the point of maximum displacement moves radially outwards as the helix is descended to a splitter. It will be understood that in embodiments not illustrated the trough working surface profile may alter from place to place along the trough so that the point of maximum displacement remains at a uniform radial distance from the helix axis but moves nearer an end of the profile by virtue that the end moves radially inwards or outwards from the axis. It will be understood that when an intermediate splitter is employed the point of maximum displacement may be moved radially inwards immediately after the splitter before recommencing radially outwards movement.

The inner zone or the outer zone of the bottom portion cross-section are not essentially of constant slope throughout the descent and the diameter of the inner wall and the outer wall of the trough while preferably constant throughout the helix are not essentially so.

In the manufacture of apparatus for use in the method it has been found desirable to manufacture a plurality of helical portions or modules having a predetermined cross-section according to the invention, some modules differing in cross-sections from others.

These portions are then linked together to form an extended helix via transition pieces. For example, an assembly may be made in which two helical modules having a cross-section as in FIG. 2A, may be linked with each other and may be linked by a transition portion with 3 interlinked modules having a cross-section as in FIG. 2B and so on.

The helix so assembled may then be tested and adjusted if necessary by inclusion or removal of helix modules.

A continuous casting (for example in glass reinforced plastic) may then be taken from the assembly of modules, with this casting then becoming a mould for the making of continuous helices of the same shape as the original assembly of modules.

As will be apparent to those skilled in the art the above described method of manufacture of helices is also applicable to helical separators other than those described herein when a change in radial cross-section is desired between the upper and lower end of the helix.

A particular advantage of preferred embodiments of the present invention is that splitters may be located on more or less flat trough areas at all altitudes. Splitters, which may be set in recesses of the trough bottom, have been found to work more efficiently when the adjacent surrounds are flat.

By virtue of the location of suitable flat areas at all altitudes, splitters of efficient design may be installed at stages in the process dictated by optimum metallurgical environment.

I claim:

1. A spiral separator having at least a portion comprising a helical trough supported with its helical axis upright for separating a pulp of water and minerals flowing theredown into mineral fractions of differing mineral density, said helical trough having an upwardly facing working surface, which, when viewed in vertical cross-section, is non-linear and is defined by a radial inner end, a radial outer end at a higher vertical location than said radial inner end and a point of maximum displacement between said ends, said point being located on said surface at a maximum spacing below a notional straight line joining said inner and outer ends;

the shape of the working surface profile varying from place to place lengthwise along the trough and the distance of the point of maximum displacement from the radial inner end of the profile also increasing lengthwise along the trough as at least a portion thereof is descended.

2. Apparatus according to claim 1 wherein the point of maximum displacement is at a radial distance from the inner end which progressively increases as at least a portion of the helix is descended.

3. Apparatus according to claim 1 wherein the point of maximum displacement increases in radial distance from the inner end at a uniform rate as at least a portion of the helix is descended.

4. Apparatus according to claim 1 wherein a profile of the trough working surface comprises a portion which is substantially linear and is between the point of maximum displacement and the inner end of the profile.

5. Apparatus according to claim 1 wherein a profile of the trough working surface comprises a portion which is substantially linear and is between the point of maximum displacement and the outer end of the profile.

6. Apparatus according to claim 1 wherein a profile of the trough working surface comprises an inner zone which is substantially rectilinear and is between the point of maximum displacement and the inner end of the profile and an outer zone which is substantially rectilinear and is between the point of maximum displacement and the outer end of the profile, said inner and outer zones lying at an angle to each other, the increase in distance from the inner end to the point of maximum displacement comprising the apex of the angle moving radially outwards as at least one portion of the helix is descended.

7. Apparatus according to claim 6 wherein the inner zone has a constant slope throughout the descent of said at least one portion.

8. A method for wet gravity separation of solids according to their specific gravity comprising the steps of introducing a pulp of said solids and water to a helical trough of an apparatus having an upright helical axis and an upwardly facing working surface on the trough, said trough being non-linear when viewed in vertical cross-section and defined by a radial inner end, a radial outer end at a higher vertical location than said outer end and a point of maximum displacement therebetween, said point being at a maximum spacing below a notional straight line joining said inner and outer ends with the shape of the working surface profile varying from place to place lengthwise along the trough and the distance of the point of maximum displacement from the inner radial end of the profile also increasing along at least a portion of the length of the trough as the pulp descends;

moving the solids of low specific gravity toward the radial outer end of the working surface by centrifugal force;

segregating the solids of high specific gravity onto the working surface to gravitate them radially inwardly;

collecting separately the radial inward and radial outward portions of the pulp by splitters positioned downstream from the introduction thereof.

9. A spiral separator for separating a pulp of water and minerals into mineral fractions of differing mineral densities, comprising:

a helical trough having an axis supported in an upright position;

said trough having an inner radial edge adjacent said axis, an outer radial edge and an upwardly facing working surface therebetween with a profile which, when viewed in vertical cross-section, is non-linear and is defined by a radial inner end, a radial outer end at a higher vertical location than said radial inner end and a point of maximum displacement between said ends which is located on said surface at a point of maximum spacing perpendicularly below a notional straight line joining said inner and outer ends;

said working surface profile varying in cross-section across its radial width lengthwise along the trough and having the point of maximum displacement moving closer to the outer end as at least a portion of the helix is descended.

10. A spiral separator for separating a pulp of water and minerals into mineral fractions of differing mineral densities, comprising:

a helical trough having a plurality of turns about an axis supported in an upright position;

said trough having an inner radial edge adjacent said axis and an outer radial edge;

an upwardly facing working surface therebetween with a profile which, when viewed in vertical cross-section across its radial width, is non-linear and is defined by a radial inner end, a radial outer end at a higher vertical location than said radial inner end and a point of maximum displacement between said ends which is located on said surface at a maximum spacing below a notional straight line joining said inner and outer ends;

an inner zone between said point of maximum displacement and said inner end, an outer zone between said points of maximum displacement and said outer end;

said working surface profile varying in vertical cross-section across its radial width as the spiral is descended with the point of maximum displacement moving radially outwardly from the inner end lengthwise along the trough and the angle of inclination between the outer zone and the upright axis being substantially constant when viewed in vertical cross-section taken along the length of the spiral.

11. The spiral of claim 10, in which the inner zone is substantially linear when viewed in said cross-section.

12. The spiral of claim 10, in which the outer zone is substantially linear when viewed in said cross-section.

13. The spiral of claim 10, in which both the inner and outer zones are substantially linear when viewed in said cross-section.

14. A spiral separator for separating a pulp of water and minerals into mineral fractions of differing mineral densities, comprising:

a helical trough having a plurality of turns about an axis supported in an upright position;

said trough having an inner radial edge adjacent said axis and an outer radial edge;

an upwardly facing working surface therebetween with a profile which, when viewed in vertical cross-section across its radial width, is defined by a radial inner end, a radial outer end at a higher vertical location than said radial inner end and a point of maximum displacement between said ends which is located on said surface at a maximum spacing below a notional straight line joining said inner and outer ends;

an inner zone between said point of maximum displacement and said inner end, an outer zone between said points of maximum displacement and said outer end;

said working surface profile varying in vertical cross-section across its radial width as the spiral is descended with the point of maximum displacement moving radially outwardly from the inner end lengthwise along the trough and the angle of inclination between the inner zone and the upright axis being substantially constant when viewed in vertical cross-sections taken along the length of the spiral.

15. The separator of claim 14, in which the angle of inclination between the outer zone and the upright axis is also substantially constant in cross-sections taken along the length of the spiral.

16. The separator of claim 15, in which the angle of inclination of the outer zone is greater than the angle of inclination of the inner zone at any particular said cross-section.

17. The spiral of claim 14, in which the inner zone is substantially linear when viewed in said cross-section.

18. The spiral of claim 14, in which the outer zone is substantially linear when viewed in said cross-section.

19. The spiral of claim 14, in which both the inner and outer zones are substantially linear when viewed in said cross-section.

20. The spiral of claim 15, in which both the inner and outer zones are substantially linear when viewed in cross-section.

21. The spiral of claim 16, in which both the inner and outer zones are substantially linear when viewed in said cross-section.

22. The separator of claim 10, in which the outer radial edge is a substantially vertical wall along at least one turn of the spiral.

23. The separator of claim 10, in which the inner radial edge is a substantially vertical wall along at least one turn of the spiral.

24. The separator of claim 10, in which the inner edge of the trough is the lowermost point of the cross-section.

25. The separator of claim 14, in which the outer radial edge is a substantially vertical wall along at least one turn of the spiral.

26. The separator of claim 14, in which the inner radial edge is a substantially vertical wall along at least one turn of the spiral.

27. The separator of claim 14, in which the inner edge of the trough is the lowermost point of the cross-section.

28. A spiral separator for separating a pulp of water and minerals into mineral fractions of differing mineral densities, comprising:

a helical trough having a plurality of turns about an axis supported in an upright position;

said trough having radially inner and radially outer substantially vertical walls along at least one turn of said spiral;

an upwardly facing working surface therebetween having a profile which, when viewed in vertical cross-section, is non-linear and is defined by a radial inner end which is substantially at the lowermost point of said cross-section, a radial outer end which is substantially at the bottom of said outer vertical wall and a point of maximum displacement between said ends which is at a maximum spacing perpendicularly below a notional straight line joining said inner and outer ends;

an inner zone between said point of maximum displacement and said inner end;

an outer zone between said point of maximum displacement and said outer end;

said working surface profile varying in vertical cross-section across its radial width with the point of maximum displacement being moved radially outwardly from the inner end as at least a portion of the helix is descended, the angle of inclination of each of the inner and outer zones in relation to the upright axis, when viewed in vertical cross-section being substantially constant along the length of the spiral.

* * * * *